US006374903B1

(12) United States Patent
Sears, Jr.

(10) Patent No.: US 6,374,903 B1
(45) Date of Patent: Apr. 23, 2002

(54) SYSTEM AND PROCESS FOR OPTIMIZING COOLING IN CONTINUOUS CASTING MOLD

(75) Inventor: James B. Sears, Jr., Cranberry Township, PA (US)

(73) Assignee: AG Industries, Inc., Coroapolis, PA (US)

( * ) Notice: Subject to any disclaimer, the term of this patent is extended or adjusted under 35 U.S.C. 154(b) by 0 days.

(21) Appl. No.: 09/658,997

(22) Filed: Sep. 11, 2000

(51) Int. Cl.[7] ..... B22D 11/124; B22D 11/16; B22D 11/22

(52) U.S. Cl. ..... 164/485; 164/443; 164/414; 164/455

(58) Field of Search ..... 164/485, 443, 164/348, 455, 414

(56) References Cited

U.S. PATENT DOCUMENTS

| | | | | |
|---|---|---|---|---|
| 2,169,893 A | | 8/1939 | Crampton et al. | |
| 2,862,265 A | | 12/1958 | Vaughn et al. | |
| 2,893,080 A | | 7/1959 | Goss | |
| 3,511,305 A | | 5/1970 | Wertli | |
| 3,528,487 A | | 9/1970 | Wognum et al. | |
| 3,763,920 A | | 10/1973 | Auman et al. | |
| 3,941,183 A | * | 3/1976 | Vedda et al. | 164/417 |
| 3,978,910 A | | 9/1976 | Gladwin | |
| 4,182,397 A | | 1/1980 | Schmucker et al. | |
| 4,535,832 A | | 8/1985 | Sevastakis | |
| 4,640,337 A | | 2/1987 | Sevastakis | |
| 5,117,895 A | | 6/1992 | Hargassner et al. | |
| 5,201,909 A | | 4/1993 | Von Wyl et al. | |
| 5,207,266 A | | 5/1993 | Nakashima et al. | |
| 5,526,869 A | * | 6/1996 | Sears, Jr. | 164/443 |
| 5,611,390 A | * | 3/1997 | Benedetti et al. | 164/485 |
| 5,771,958 A | * | 6/1998 | Sears, Jr. | 164/443 |

FOREIGN PATENT DOCUMENTS

| | | |
|---|---|---|
| SU | 952422 | 8/1992 |

* cited by examiner

*Primary Examiner*—M. Alexandra Elve
*Assistant Examiner*—Len Tran
(74) *Attorney, Agent, or Firm*—Knoble & Yoshida, LLC

(57) ABSTRACT

An improved process of operating a continuous casting mold of the type that includes at least one mold surface and at least one coolant passage that is in thermal communication with the mold surface includes determining based on at least one factor whether it would be most advantageous to direct coolant through the coolant passage in a first direction or in a second, opposite direction. For example, if the mold liner is beneath a predetermined thickness it may be advantageous to circulate the coolant so that it enters the water jacket and the coolant slots that are defined in the mold liner at the bottom and exiting from the top so that there is some prewarming of the coolant before it reaches the meniscus region. Conversely, if the mold liner is thicker it may be desirable to introduce the coolant at the top of the water jacket, thus enhancing the cooling effect in the meniscus region.

33 Claims, 4 Drawing Sheets

SYSTEM AND PROCESS FOR OPTIMIZING COOLING IN CONTINUOUS CASTING MOLD

BACKGROUND OF THE INVENTION

1. Field of the Invention

This invention relates generally to continuous casting of metals, particularly steel. More specifically, this invention pertains to an improved continuous casting mold and processes for operating and retrofitting continuous casting molds that provide enhanced cooling during the solidification process.

2. Description of the Related Technology

Several different types of continuous casting molds are used in the metal casting industry today. The main differences between molds relate to the size and shape of the products being cast. Billet production, i.e. small cross-sections generally used for manufacturing so-called "long products" such as structural steel shapes (angles and channels), rails, rod and wire, are generally cast through a copper tube mold. The inside of the copper tube serves as the casting surface, forming a product that is equal in size and shape to the inside of the copper tube itself. The outside of the copper tube is water cooled, generally by fast flowing water, but sometimes by spray water.

Most billet casting machines used for making long products have multiple molds and produce multiple strands of steel simultaneously as they are fed from a single tundish. The tundish in a continuous casting operation is a refractory-lined vessel used to feed the mold or multiple molds in this case.

Another type of mold commonly used in continuous casting forms a slightly larger cross-section called a bloom. A bloom can be round and formed in a round copper tube mold, but it is more generally a rectangular shape used to make long products as well as seamless plates in tubes. A mold of this type typically includes a number of liner plates, usually made of copper, and water jackets surrounding the liner plates. The liner plates are often referred to as "coppers," and define a portion of the mold that contacts the molten metal during the casting process. Parallel vertically extending water circulation slots or passageways are provided between the water jackets and the liner plates to cool the liner plates. During operation, water is introduced to these slots, almost always from the bottom end of the mold, from a water supply via an inlet plenum that is in communication with all of the slots in a liner plate. The cooling effect so achieved causes an outer skin of the molten metal to solidify as it passes through the mold. The solidification is then completed after the semi-solidified casting leaves the mold by spraying additional coolant, typically water, directly onto the casting. This method of metal production is highly efficient, and is in wide use in the United States and throughout the world.

In the case of a rectangular shaped bloom mold, four plates (i.e. two widefaces and two narrowfaces) generally form the mold cavity. These four separate copper mold liners generally fit together to form a nonadjustable rectangular box that serves as the casting chamber. Commonly, a four piece bloom mold will have chamfered comers as opposed to the square comers found in a four piece slab mold.

Slabs are also rectangular in shape, but are generally much wider than they are thick. Slab casting accounts for the major share of the nearly 800 million tons of continuously cast steel product produced worldwide per annum. Most slab molds and bloom molds have four copper plates that serve as the inner casting surface of the mold. Typically, these mold liners are slotted on the back side to form cooling passages through which cooling water can flow. In some cases, the cooling passages are formed by drilling a series of vertical round holes, but this method has cost implications and performance limitations that are generally not found in the slotted copper design.

Another mold type that is called the "beam blank mold" is used to cast a strand of metal in the shape of an H-beam that can be further reduced in section to a size that is commonly used or structural purposes, such as the construction of buildings and bridges. Beam blank production is commonly referred to as a form of "near net shape" casting because the continuously cast shape is very near to the final size and shape of the product.

Smaller H-beam product sizes are being made in beam-shaped copper tube molds while larger product sizes are made in four plate molds. The wideface coppers of a four plate beam blank mold are generally produced from very thick pieces of copper. In this case, drilled holes are the normal method used for cooling passages since slotting such a thick piece of copper would be impractical. The cooling passages of all molds are positioned such that they surround the perimeter of the cast product to remove heat from the liquid metal being poured into the mold. Thus the cooling passages surrounding the perimeter of a beam blank mold are very complex when compared to those of flat plate molds such as those that are used for blooms and slabs.

The thermal/mechanical dynamics of continuous casting molds, particularly near net shape molds, grow to be more complex with the shape of the mold cavity. Funnel molds are another type of near net shape casting mold with its own set of unique dynamics. Funnel molds have an enlarged pouring region and are generally four plate molds used for casting thin slabs. Thin slab molds need this funnel because the widefaces are brought very close together to form a thin slab measuring only two to three inches in thickness, as opposed to more conventional slabs that generally measure 6 to 12 inches in thickness. Since steel is generally poured into a continuous casting mold through a refractory tube called a submerged entry nozzle or SEN, the enlarged pouring region or funnel provides space for the SEN and the steel to enter the mold.

Thin slab casting has grown to be more widely used today because of the economics of rolling a thin slab into a coil of steel. The thin slab process also lends itself well to hot charging or going directly from the caster into the rolling mill without having to totally reheat the product. It further lends itself well to the mini-mill environment of electric arc furnace production as opposed to the iron-based oxygen furnace methods of the integrated steel producers. Thus, thin slab casting reduces energy consumption and is better for the environment, two important factors in today's world. In the United States, thin slab casting through funnel molds accounts for nearly 20 percent of the hot band coil production and is expected to continue growing into the future.

Funnel molds have very complex thermal/mechanical dynamics. Since the product being cast is thin, for example ⅕ the thickness of a normal slab, casting speed has to be increased by a factor of 5 to match the production tonnage capability of the thicker slab casting process. Along with this increase in casting speed comes an increase in the mold copper surface temperatures, which are very detrimental to the service life of the mold. This increase in temperature brings about a large amount of thermal expansion and deformation of the mold coppers, which limit their life as well. As a result of all of this, the maintenance cost of funnel molds is much higher than that of conventional, thick-slab casting molds.

To better understand the thermal profiles of a mold in continuous casting, researchers and machine operators have monitored the temperatures of the copper liners by instrumenting them with a series of thermocouples. They learned that the area just below the top of the liquid metal, and what is known in the industry as the meniscus area, is generally the hottest.

In continuous casting, molten metal comes into contact with the upper surface of the water-cooled mold in the meniscus area where it first surrenders heat. This transfer of heat begins the solidification process, forming the shell or outer skin of the cast product. As the solidifying shell travels downward through the mold and eventually through the containment area below the mold, it continues to relinquish heat and grows in thickness. This occurs at a rate equal to the conductivity of the metal being cast and the intensity of the cooling media being applied to the surface of the strand. The shell eventually achieves total solidification before it reaches the end of the casting machine and that is the basis of continuous casting.

As shell thickness increases, it acts as an insulating layer between the hot liquid core of the cast product and the source of cooling, whether this is the water-cooled mold walls or the cooling water sprays and the containment area below. The thicker the shell becomes, the more insulation it provides and the cooler the strand surface temperature becomes. A large amount of heat removal occurs in the mold itself and the shell grows to be approximately ⅜ to ⅝ of an inch in thickness before it exits the mold. Thus, the lower area of the mold is generally cooler than the upper area, because the shell insulates the mold wall from the liquid core of the strand.

Due to certain mechanical restrictions and water sealing requirements, the very top and bottom of copper mold liners are not cooled as efficiently as the areas in between. Recent studies show a significant temperature rebound near the very bottom of the mold where water generally enters the cooling passages on the back side of the copper mold liner. This is primarily due to the drop in cooling water velocity found in those regions. This weakness can be eliminated through the use of velocity plates as are described in U.S. Pat. No. 5,526,869, the entire disclosure of which is incorporated as if set forth fully herein.

During continuous casting, a number of operating conditions must be achieved in order to keep the process going nonstop, thus maximizing the amount of tons produced. Of equal importance is the optimization of the operating conditions that can affect product quality. The value of prime product is much greater than that of secondary product, thus high product quality is the goal of every continuous casting operation.

Mold performance is a major factor in producing a high-quality continuous cast product. In fact, what happens in the meniscus area of the mold generally controls the quality level of the product. Uniform heat extraction in the mold is desired for quality purposes. A uniform shell thickness will be free of the stresses that can lead to a longitudinal cracking. It is also desirable to have similar temperatures on opposing faces in a mold and the right balance of temperatures between widefaces and narrowfaces to minimize stresses in the corners of the product.

Because of the unique dynamics of thin slab funnel molds, thin coppers can result in overcooling that leads to longitudinal cracking or what is known in the thin slab casting industry as caster folds. As a result, thin slab coppers are generally scrapped out for this reason with 15 to 19 mm of stock still remaining between the hot face and the cooling passages. This contributes to the added cost of maintaining funnel molds, even though it keeps the mold operating in the optimum temperature range for the best product quality.

One logical approach to increasing the life of funnel mold coppers would be to make the coppers thicker when they are new. Unfortunately, the thicker the copper, the hotter the surface temperature is during service. Due to the high casting speeds used in thin slab casting, molds sometimes last only a few days, particularly new copper molds, before they are so badly deformed from the heat that the product quality drops off. Overheated mold surfaces can also result in surface crack formation in the mold coppers themselves and can also cause molten metal to stick to the surface of the mold, which results in a tearing of the shell, which is called a sticker breakout.

A breakout in the continuous casting industry is the name given to an event where the shell gets a hole in it and the molten metal within the shell leaks out once the hole has been exposed below the mold. It can cause severe damage to the containment equipment below the mold and an unscheduled interruption to the casting process while it is cleaned up. Breakouts can cost the steel producer anywhere from $50,000 to $1 million depending on its severity and the type of casting operation. Breakouts on a thin slab caster are generally less severe because the volume of metal in the mold is less than that in a thick slab mold.

A mold copper lining plate has a life expectancy that begins at the time it is new, and at its maximum thickness. After having repeatedly been re-machined to remove wear and surface deterioration that occurs during service in the casting machine, a mold copper will get thinner and thinner until it is no longer safe to use. Each casting operation sets a low limit for the operating thickness to assure that cracks in the copper itself will not result in water leakage through the hotface. Such occurrence could result in an explosion that would send molten metal erupting out of the mold and potentially harm the operators or other people in that area. A typical range of safety stock remaining between the hot face and the cooling water passages of a normal mold copper would be from 5 mm to 10 mm at the time it is scrapped out.

Cooling water in a continuous casting mold generally flows through the water passages or slots on the backside of the copper in a direction from bottom to top. The main advantage to doing it this way is to push the air out of the slots or passages ahead of the incoming water. Air trapped inside the cooling water passages can cause overheating of the copper liners and uneven heat removal in the mold. However, at the cooling water velocities used in molds today, there is little chance that air could withstand water flows ranging from 6 to 12 meters per second, or 20 to 40 feet per second.

Bottom to top water flow also provides product quality advantages by preheating the water in the lower portion of the mold before it reaches the meniscus. This avoids over cooling of the product at the meniscus where the quality level of the product is dictated, particularly as the copper gets thinner after it has been remachined the few times.

SUMMARY OF THE INVENTION

However, the inventor has determined that with the desire to cast faster, particularly in the thin slab machines, there are certain advantages of reversing the water flow direction and forcing it to run from top to bottom. Cool water contacting the meniscus area first can reduce the copper temperatures in that area and would allow the use of thicker coppers when they are new. Even one millimeter of additional thickness on a new copper can provide an additional campaign, which would create a very real economic advantage to the steel producer. Given the fact that funnel mold liners or coppers typically only last four to six campaigns before they are scrapped out, an extra campaign may be worth from $10,000 to $20,000 to the steelmaker, a value that far outweighs the additional cost of the raw copper material.

In addition, lowering the meniscus temperature during high-speed casting can prevent cracking and deformation of the copper liners, extending the campaign life between remachining. This will allow the mold to stay in the machine for an extended period of time, increasing the throughput of the machine and adding to the total number of heats a pair of mold copper liners can provide during their lifetime.

As the trend to a speed up the continuous casting process continues, water flow direction in the mold can play a large part in enabling the increasing cast speed to happen without sacrificing mold and copper life. New flow direction control methods can also help keep the copper in the optimum operating range for the best product quality. Introducing the coolant near the top of a cooling slot can also increase coolant pressure in the area near the intended meniscus location, thereby increasing the boiling temperature at that location, thus suppressing the possibility of nucleate boiling which could lead to uneven cooling in the mold.

For instance, having the ability to reverse the cooling water flow direction as coppers get thinner can provide the best of both worlds. Top to bottom flow could be used when the copper is above a certain thickness threshold to intensify the cooling of the meniscus area. As the copper gets thinner and nearer to its scrapping size, the flow can be reversed to run bottom to top so as not to overcool the meniscus area. Having this ability can increase mold and copper life, providing an enormous commercial advantage to the user.

Flow reversal control can also assist in controlling temperature similarities of opposing faces in the mold. If one copper is thinner than the other, the two copper surface temperatures can be more closely matched by flowing bottom to top on the thinner copper and top to bottom on the thicker copper.

Such a flow control system can help match the temperatures on multiple mold machines as well, particularly where the cast speeds are all the same. For instance, a six strand billet caster may have to be shut down early because one or more of the molds have new copper tubes while the others are thinner. By matching the flow direction of each mold to the thickness of its copper, the weak link can be eliminated and additional cast speeds, casting time and mold life could be achieved. On a bloom machine sharing a common speed control (combination slab/bloom machines) mold copper surface temperature can be matched to maximize the cast performance of two or more molds with different copper thicknesses.

Different methods and systems could be used to control water flow direction in a continuous casting mold. One way would be in the design of the mold water jackets. A water jacket in a continuous casting mold is the structural member that provides mechanical support to keep the copper liners flat during service. It also acts as the cooling water conduit to channel water to the top and bottom of the copper liners. The internal construction would dictate which direction the cooling water would travel. Different water jackets could be used with different copper thicknesses or a water jacket can be designed with an internal switching mechanism. Perhaps the most practical method for controlling mold cooling water flow direction would be in the water piping below the mold. Valves and other control devices could be incorporated into the mold water piping system to perform the switching function. A flow control system of this type could be easily installed on new machines during their construction or could be added to existing machines to provide the benefits listed herein. Payback of such casting machine upgrades would be very short for a high-speed casting operation.

In order to achieve the above and other objects of the invention, a method of operating a continuous casting mold of the type that includes at least one coolant passage for ducting a coolant during casting includes, according to a first aspect of the invention, steps of conducting a casting operation while forcing a coolant through the coolant passage in a first direction; and conducting a subsequent casting operation while forcing a coolant through the coolant passage in a second direction that is opposite of the first direction.

According to a second aspect of the invention, a method of operating a continuous casting mold of the type that has at least one casting surface and at least one coolant passage in thermal communication with said casting surface includes steps of determining, based on at least one factor, whether the cooling provided by the coolant passage would be most advantageous to the casting process if coolant is forced through the coolant passage in a first direction or in an opposite, second direction; and operating the continuous casting mold with coolant being forced through the coolant passage in the direction that has been selected .

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
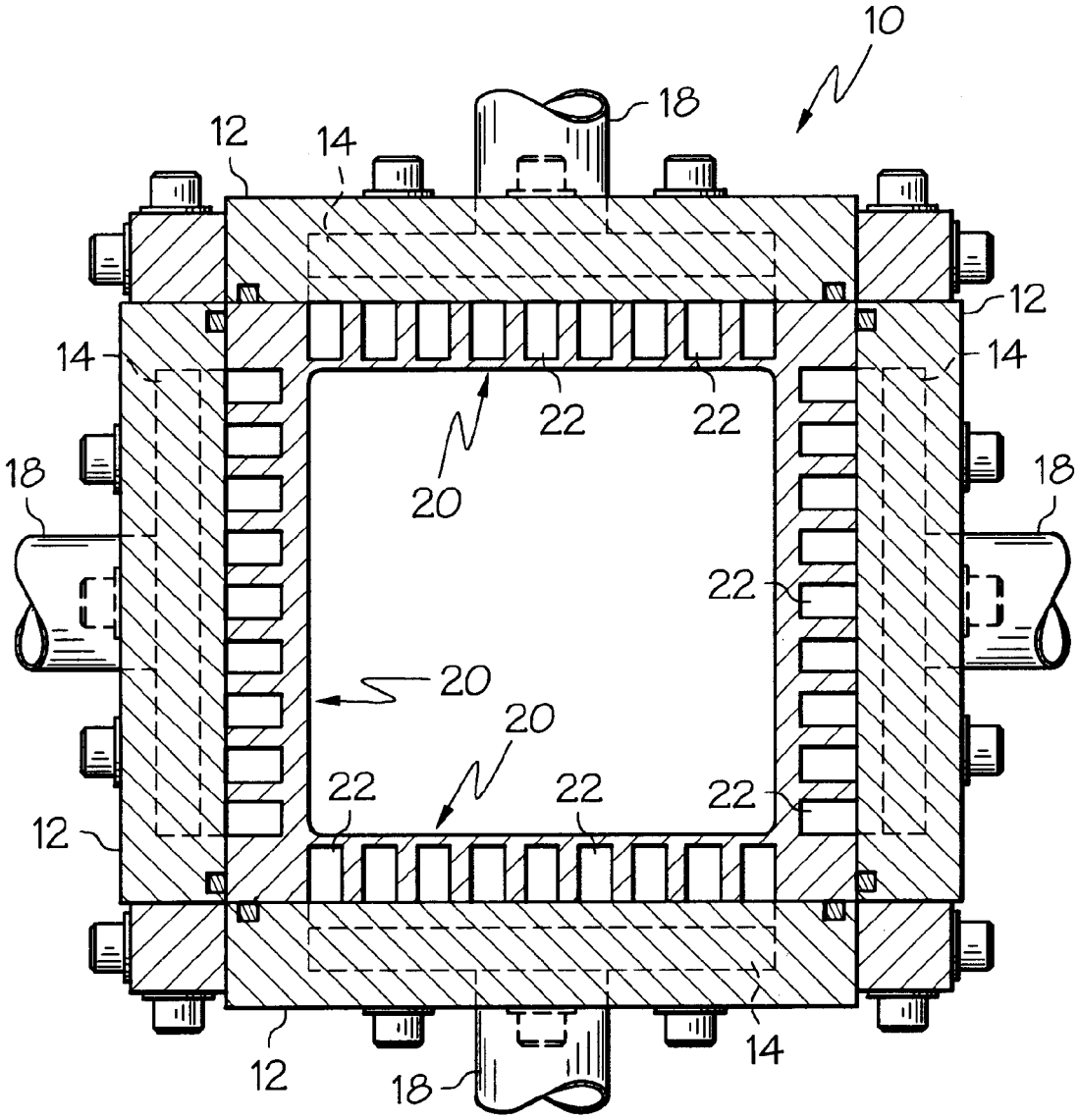
FIG. 1 is a fragmentary cross-sectional view taken through a continuous casting mold that is constructed according to a preferred embodiment of the invention.
Figure 2:
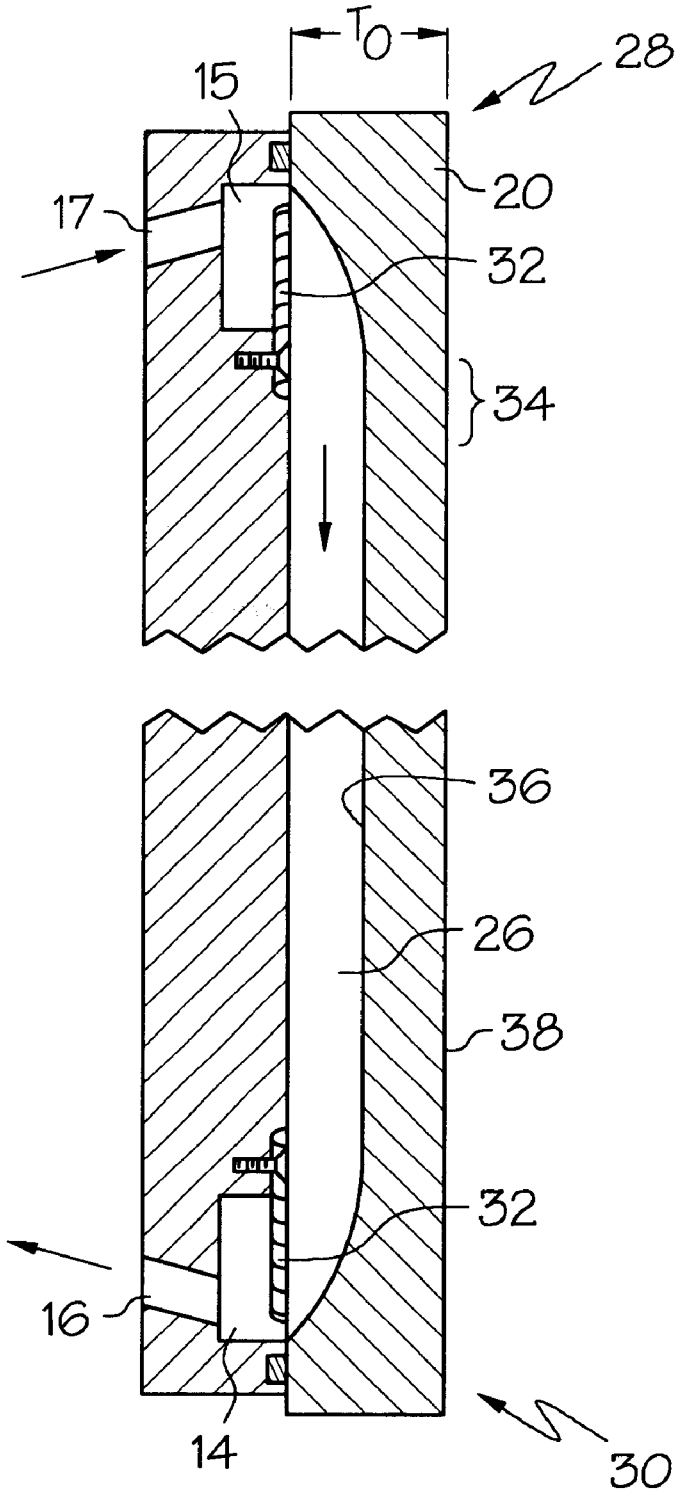
FIG. 2 is a cross-sectional view depicting one area of the continuous casting mold that is shown in FIG. 1.

Referring now to the drawings, wherein like reference numerals designate corresponding structure throughout the views, and referring in particular to FIG. 1, an improved continuous casting mold 10 that is constructed according to a preferred embodiment of the invention includes four outer walls or water jackets 12 that each have a lower plenum 14 defined therein. As may be seen in FIGS. 1 and 2, each of the outer walls or water jackets 12 further has a lower passage 16 defined therein, to communicate lower plenum 14 with a external coolant conduit, which in the preferred embodiment is a lower water pipe 18. Referring briefly to FIG. 2, it will be seen that each of the water jackets 12 further has an upper plenum 15 defined therein and further has an upper passage 17 for communicating the upper plenum 15 with a second external coolant conduit, which in the preferred embodiment is an upper water pipe 19, which is shown schematically in FIG. 4.

Continuous casting mold 10 also includes four mold liners or "coppers" 20 each of which has a hot face or casting surface and is secured to an inner surface of a respective water jacket 12, as may best be seen in FIG. 1. The hot faces or casting surfaces of the liner walls 20 together define a mold surface through which molten material such as steel may be passed and shaped, as is well known in this area of technology and is described in detail above. Each "copper" 20 or liner plate is preferably fabricated from a material that has high thermal connectivity, preferably copper, as is also well known in this technical area.

As may be seen in FIG. 1, each liner wall 20 has a number of slots 22 defined in an inner surface thereof which, together with the respective water jacket 12, defines a number of the passages 26, shown in FIG. 2, for transporting coolant such as water to cool the liner 20 during operation of the mold 10. Referring again to FIG. 2, in the preferred embodiment each of the passages or water slots 26 is oriented so as to be substantially vertical, having an upper end that is located near an upper end 28 of the water jacket 12 and a lower end that is located near a lower end 30 of the water jacket 12. A first velocity plate 32 is positioned between the lower plenum 14 and the lower end of the passage 26, as is shown in FIG. 2, and similarly a second velocity plate is likewise positioned between the upper plenum 15 and the upper end of the passage 26.

FIG. 2 depicts a mold liner or copper 20 that is substantially new and that exhibits an original thickness $T_o$ between the innermost extent 36 of passage 26, which is also known as the slot bottom, and the hotface or casting surface 38. At this thickness, it may be desirable to provide enhanced cooling to the meniscus region 34 of the casting surface 38. Accordingly, one important advantage that is provided by the invention is the step of making the determination that it is so desirable to direct the coolant from top to bottom and then initially introducing the coolant into the upper portion of the passage 26 in a direction toward the lower portion of the passage 26 so that the coolant that contacts the slot bottom 36 in the area of the slot bottom 36 that is close to the meniscus region 34 will have been preheated as little as possible.

Figure 3:
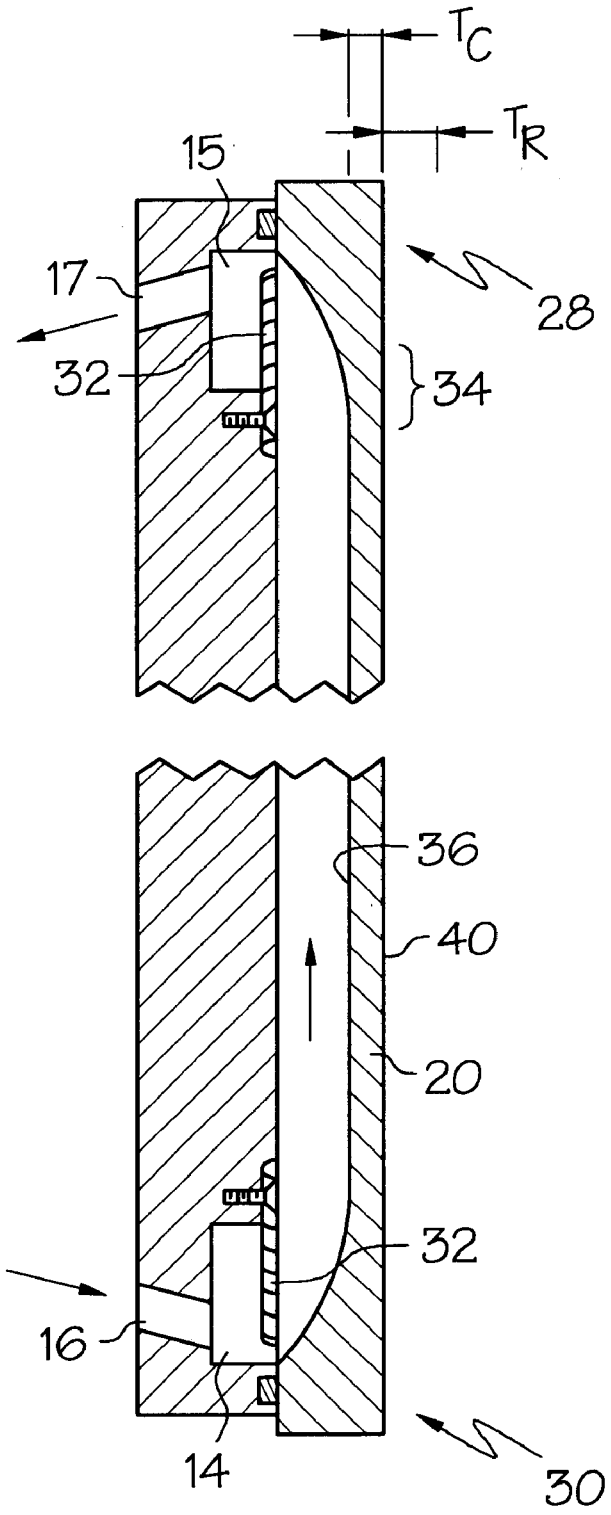
FIG. 3 is a cross-sectional view, similar to that of FIG. 2, showing the area of the continuous casting mold after a significant amount of the material in the mold liner has been removed through extended use and reconditioning.

FIG. 3 depicts a mold liner or copper 20 that through wear and the machining that is performed during reconditioning has become much thinner than it was originally. Specifically, the mold liner or copper 20 shown in FIG. 3 exhibits a thickness $T_c$ between the slot bottom 36 and the new casting surface 40 that represents an erosion of thickness with respect to the original size of the mold liner that is of a value $T_R$.

According to one particularly advantageous embodiment of the invention, casting with a mold liner 20 that is new will be performed with the coolant being directed from top to bottom within the coolant passage 26. Each time after the mold liner has been reconditioned, a new determination will be made whether the coolant should be directed from top to bottom or from bottom to top. In this embodiment, the determination is made based on the remaining thickness $T_c$ of the mold liner between the slot bottom 36 and the casting surface 38. The specific value of $T_c$ at which the decision will be made to reverse the coolant flow will be made based on a number of factors. For example, the determination of $T_c$ could be based in part or in whole on measured temperatures during casting. The determination may also be based in whole or in part on the desired casting speed, on the composition of the material from which the mold liner 20 is fabricated, or on various surface treatments that may have been applied to the casting surface 38. Alternatively, the determination could be made based simply on an anticipated midpoint of the life of the mold liner 20.

In the preferred embodiment, the value of $T_c$ at which the decision to reverse the coolant flow will depend most heavily on the type of mold that is being used (i.e. whether the mold is a conventional slab mold or a high speed funnel mold), and on the composition of the mold liner (i.e. whether the mold liner is fabricated from silver-bearing copper or chromium-zirconium copper, the details of both being well known in the industry). The following table sets forth the preferred and more preferred ranges for $T_c$ for all combinations of these most important factors:

| TYPE OF MOLD | MOLD LINER COMPOSITION | PREFERRED RANGE FOR $T_C$ (mm) | PREFERRED RANGE FOR $T_C$ (in) | MORE PREFERRED RANGE FOR $T_C$ (mm) | MORE PREFERRED RANGE FOR $T_C$ (in) |
|---|---|---|---|---|---|
| FUNNEL | SILVER-BEARING COPPER | 12–22 | 0.47–0.87 | 14–20 | 0.55–0.79 |
| FUNNEL | CHROMIUM-ZIRCONIUM COPPER ALLOY | 10–19 | 0.39–0.75 | 12–17 | 0.47–0.67 |
| CONVENTIONAL SLAB | SILVER-BEARING COPPER | 5–30 | 0.20–1.18 | 8–27 | 0.31–1.06 |
| CONVENTIONAL SLAB | CHROMIUM-ZIRCONIUM COPPER ALLOY | 4.6–26 | 0.18–1.02 | 7–23 | 0.28–.91 |

Figure 4:
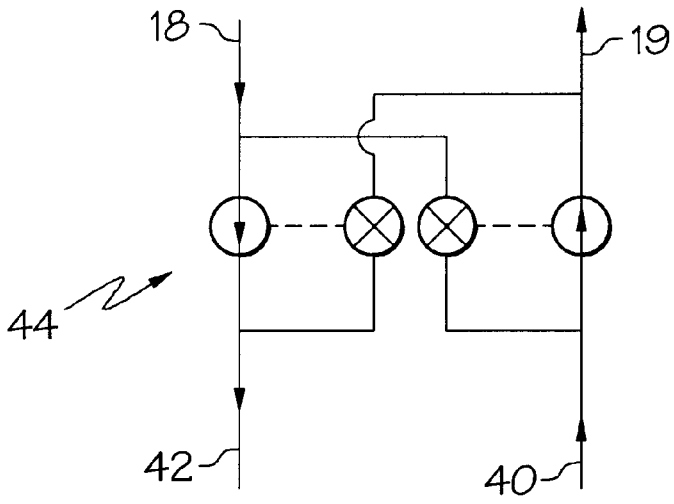
FIG. 4 is a schematic diagram depicting a piping system for the continuous casting mold.

In the preferred embodiment, and as is best shown in FIG. 4, the preferred apparatus for permitting the coolant to be directed selectively from either top to bottom or bottom to top within the water jacket includes a simple valve arrangement 44 that is preferably positioned in the water piping beneath the continuous casting mold. A water supply pipe 40 supplies pressurized water or other coolant to the continuous casting mold, while a water return line 42 provides a return path for water that has been circulated through the continuous casting mold. Supply pipe 40 and return line 42 are preferably, and as is common throughout the industry, part of a continuous circulation system that includes a filtration area and an external cooling area that typically includes a heat exchanger and cooling tower for transferring the waste heat to the environment.

Figure 5:
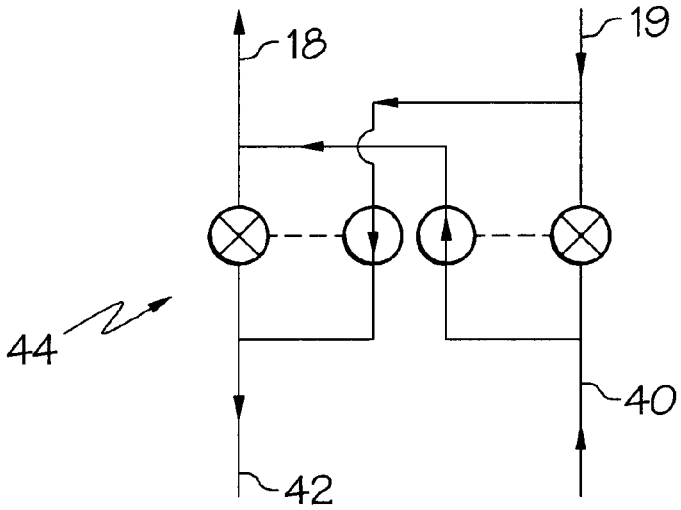
FIG. 5 is the schematic diagram of FIG. 4 shown in a second operational position.

As may be seen in FIG. 4, the valve arrangement 44 is configured in a situation such as that which is shown in FIG. 2 wherein the water supply pipe 40 is communicated with the upper water pipe 19, which provides a path into the upper plenum 15 into the upper passage 17, as is shown in FIG. 2. The coolant water flows downwardly through the passage 26, as is shown in FIG. 2, into the lower plenum 14 and out through the lower passage 16 and into the lower water pipe 18 where it is communicated with return line 42. In the situation that is depicted in FIGS. 3 and 5, supply pipe 40 is instead communicated by the valve arrangement 44 with the lower water pipe 18, forcing the cooling water into the lower passage 16, through the lower plenum 14 and upwardly through the passage 26, wherein the coolant is preheated before it reaches the portion of the slot bottom 36 that is close to the meniscus region 34. Accordingly, the cooling effect is slightly mitigated, which is beneficial because of the thin condition of the mold liner 20. The coolant continues upwardly into the upper plenum 15, outwardly through the upper passage 17 and into the upper water pipe 19, which is communicated by the valve arrangement 44 with the return line 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of operating a continuous casting mold of the type that includes at least one coolant passage for ducting a coolant during casting, comprising the steps of:

(a) conducting a casting operations while forcing a coolant through said coolant passage in a first direction, wherein said coolant passage comprises a slot that is defined in a mold liner, and wherein said slot has a top end and a bottom end; and (b) conducting a subsequent casting operation while forcing a coolant through said coolant passage in a second direction that is opposite of said first direction, wherein step (b) is performed in the immediately subsequent casting operation only in the event that said thickness of said mold liner that remains between a bottom of said slot and said casting surface is less than a predetermined minimum thickness.

2. A method according to claim 1, wherein step (a) is performed by forcing a coolant through said slot in a first direction that extends from said top end toward said bottom end.

3. A method according to claim 1, further comprising a step of reconditioning said mold liner between step (a) and step (b).

4. A method according to claim 3, wherein said step of reconditioning said mold liner comprises removing an amount of material from a casting surface of said mold liner so as to recondition said casting surface and then determining a thickness of said mold liner that remains between a bottom of said slot and said casting surface.

5. A method according to claim 1, wherein said continuous casting mold is a funnel mold, and wherein said predetermined minimum thickness is within a range of about 0.39 inches to about 0.87 inches.

6. A method according to claim 5, wherein said mold comprises a mold liner that is fabricated from a material comprising a silver-bearing copper alloy, and wherein predetermined minimum thickness is within a range of about 0.47 inches to about 0.87 inches.

7. A method according to claim 6, wherein said predetermined minimum thickness is within a range of about 0.55 inches to about 0.79 inches.

8. A method according to claim 5, wherein said mold comprises a mold liner that is fabricated from a material comprising a chromium-zirconium copper alloy, and wherein predetermined minimum thickness is within a range of about 0.39 inches to about 0.75 inches.

9. A method according to claim 8, wherein said predetermined minimum thickness is within a range of about 0.47 inches to about 0.67 inches.

10. A method according to claim 1, wherein said continuous casting mold is a conventional slab mold, and wherein said predetermined minimum thickness is within a range of about 0.18 inches to about 1.18 inches.

11. A method according to claims 10, wherein said mold comprises a mold liner that is fabricated from a material comprising a silver-bearing copper alloy, and wherein predetermined minimum thickness is within a range of about 0.20 inches to about 1.18 inches.

12. A method according to claim 11, wherein said predetermined minimum thickness is within a range of about 0.30 inches to about 1.06 inches.

13. A method according to claim 10, wherein said mold comprises a mold liner that is fabricated from a material comprising a chromium-zirconium copper alloy, and wherein predetermined minimum thickness is within a range of about 0.18 inches to about 1.02 inches.

14. A method according to claim 13, wherein said predetermined minimum thickness is within a range of about 0.28 inches to about 0.91 inches.

15. A method of operating a continuous casting mold of the type that has at least one casting surface and at least one coolant passage in thermal communication with said casting surface, comprising the steps of:

(a) determining, based on at least one factor, whether the cooling provided by said coolant passage would be most advantage to the casting process if coolant is forced through said coolant passage in a first direction or in an opposite, second direction, wherein a factor that is considered in step (a) comprises a thickness of a mold liner in said continuous casting mold; and (b) operating said continuous casting mold with coolant being forced through said coolant passage in the direction that has been selected in step (a), wherein said coolant passage comprises a slot that is defined in said mold liner, and wherein said thickness that is considered in step (a) is a thickness of said mold liner that remains between a bottom of said slot and said casting surface.

16. A method according to claim 15, wherein step (a) is further performed in reliance as to whether said thickness is less than a predetermined minimum thickness.

17. A method according to claim 16, wherein said continuous casting mold is a funnel mold, and wherein said predetermined minimum thickness is within a range of about 0.39 inches to about 0.87 inches.

18. A method according to claim 17, wherein said mold comprises a mold liner that is fabricated from a material comprising a silver-bearing copper alloy, and wherein predetermined minimum thickness is within a range of about 0.47 inches to about 0.87 inches.

19. A method according to claim 18, wherein said predetermined minimum thickness is within a range of about 0.55 inches to about 0.79 inches.

20. A method according to claim 16, wherein said mold comprises a mold liner that is fabricated from a material comprising a chromium-zirconium copper alloy, and wherein predetermined minimum thickness is within a range of about 0.39 inches to about 0.75 inches.

21. A method according to claim 20, wherein said predetermined minimum thickness is within a range of about 0.47 inches to about 0.67 inches.

22. A method according to claim 16, wherein said continuous casting mold is a conventional slab mold, and wherein said predetermined minimum thickness is within a range of about 0.18 inches to about 1.18 inches.

23. A method according to claim 22, wherein said mold comprises a mold liner that is fabricated from a material comprising a silver-bearing copper alloy, and wherein predetermined minimum thickness is within a range of about 0.20 inches to about 1.18 inches.

24. A method according to claim 23, wherein said predetermined minimum thickness is within a range of about0.30 inches to about 1.06 inches.

25. A method according to claim 22, wherein said mold comprises a mold liner that is fabricated from a material comprising a chromium-zirconium copper alloy, and wherein predetermined minimum thickness is within a range of about 0.18 inches to about 1.02 inches.

26. A method according to claim 25, wherein said predetermined minimum thickness is within a range of about 0.28 inches to about 0.91 inches.

27. A method according to claim 15, wherein said thickness is measured in an area that is proximate to an anticipated meniscus location.

28. A method according to claim 15, wherein said thickness is measured in an area that is proximate to an anticipated meniscus location.

29. A method according to claim 15, wherein a factor that is considered in step (a) comprises a desired pressure condition in a portion of said coolant passage.

30. A method according to claim 29, wherein said desired pressure condition comprises a desired coolant pressure condition in an area of said coolant passage that is closest to an intended meniscus location.

31. A method according to claim 15, wherein a factor that is considered in step (a) comprises the anticipated casting speed of the continuous casting mold.

32. A method according to claim 15, wherein a factor that is considered in step (a) is an anticipated percentage of the useful life of a mold liner that is in thermal communication with said coolant passage.

33. A method according to claim 15, wherein a factor that is considered in step (a) is the type of continuous casting mold.

* * * * *